US008026674B2

(12) United States Patent
Berk et al.

(10) Patent No.: US 8,026,674 B2
(45) Date of Patent: Sep. 27, 2011

(54) ELECTRON SOURCE AND METHOD FOR THE OPERATION THEREOF

(75) Inventors: Jan Berk, Hohenroda (DE); Josef Deuringer, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 452 days.

(21) Appl. No.: 12/205,002

(22) Filed: Sep. 5, 2008

(65) Prior Publication Data

US 2009/0058319 A1 Mar. 5, 2009

(30) Foreign Application Priority Data

Sep. 5, 2007 (DE) ..... 10 2007 042 108

(51) Int. Cl.
*H05B 41/14* (2006.01)

(52) U.S. Cl. ..... 315/291; 315/381; 315/106; 315/107; 315/11.81; 313/309; 313/336; 313/351; 378/119; 378/136

(58) Field of Classification Search ..... 315/381, 315/106, 107, 111.81, 291, 11.81; 313/309, 313/336, 351; 378/136, 119
See application file for complete search history.

(56) References Cited

U.S. PATENT DOCUMENTS

| | | | | |
|---|---|---|---|---|
| 4,379,250 | A | 4/1983 | Hosoki et al. | |
| 5,138,232 | A | 8/1992 | Schleiff et al. | |
| 5,386,172 | A * | 1/1995 | Komatsu | 313/309 |
| 5,579,236 | A * | 11/1996 | Tamamura et al. | 702/64 |
| 5,808,425 | A * | 9/1998 | Harle | 315/381 |
| 6,333,968 | B1 * | 12/2001 | Whitlock et al. | 378/136 |
| 6,400,090 | B2 * | 6/2002 | Katsap et al. | 315/111.81 |
| 6,942,186 | B1 * | 9/2005 | Levin et al. | 244/158.2 |

FOREIGN PATENT DOCUMENTS

| | | |
|---|---|---|
| DE | 24 60 424 A1 | 7/1976 |
| DE | 31 30 383 | 4/1982 |
| DE | 32 39 337 | 4/1984 |
| GB | 1 331 113 | 9/1973 |
| JP | 57050757 A | 3/1982 |
| JP | 59040449 A | 3/1984 |
| JP | 59040450 A | 3/1984 |

* cited by examiner

*Primary Examiner* — Douglas W Owens
*Assistant Examiner* — Thai Pham
(74) *Attorney, Agent, or Firm* — Schiff Hardin LLP

(57) ABSTRACT

An electron source has an electron emitter with an electron emission cathode, a high voltage unit provided for power supply of the electron emission cathode, and a low voltage unit provided to control the high voltage unit. Data are transmitted non-electrically (in particular optically) between the high voltage unit and the low voltage unit.

13 Claims, 1 Drawing Sheet

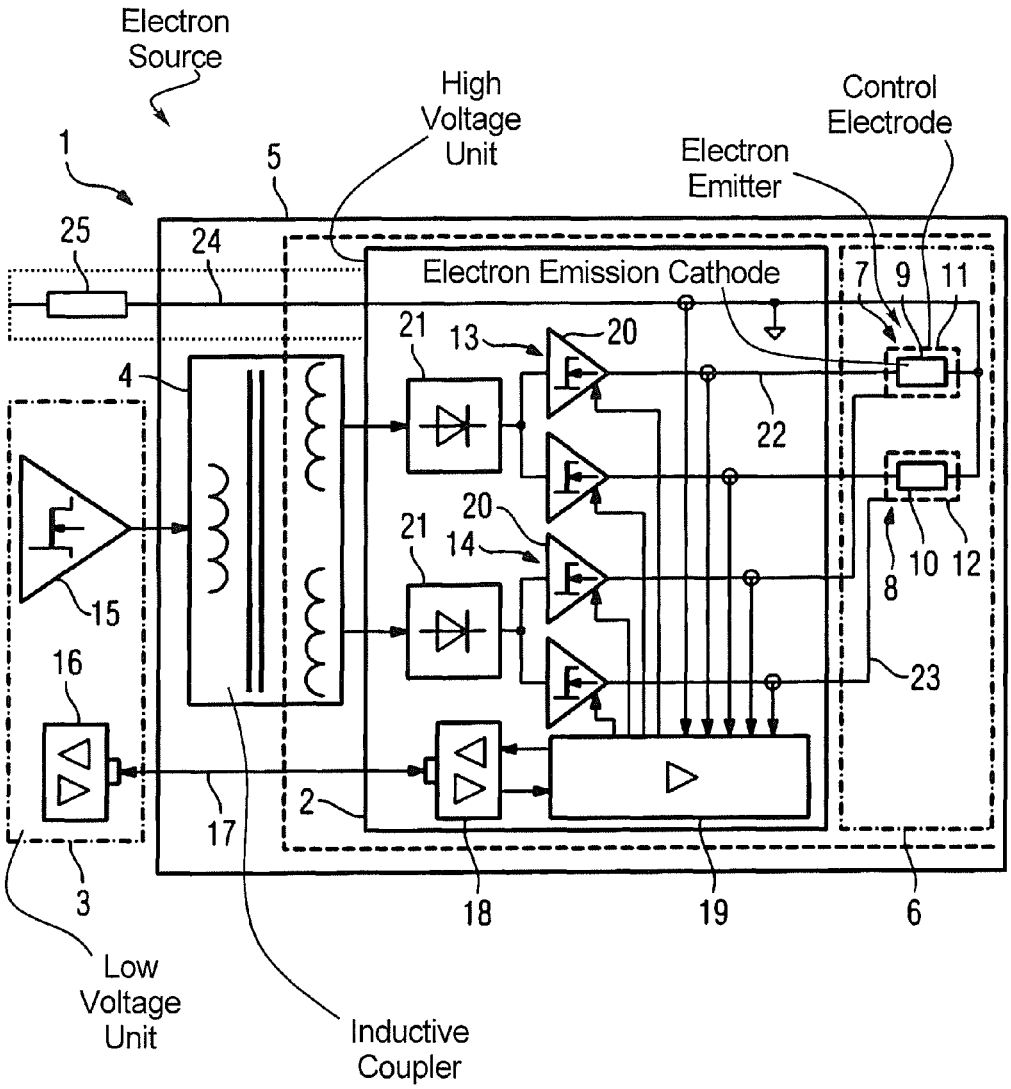
Electron Source
High Voltage Unit
Control Electrode
Electron Emitter
Electron Emission Cathode
1
5
25
24
7
9
11
21
13
20
4
22
20
21
14
10
12
8
15
16
23
2
17
3
18
19
6
Low Voltage Unit
Inductive Coupler

ELECTRON SOURCE AND METHOD FOR THE OPERATION THEREOF

BACKGROUND OF THE INVENTION

1. Field of the Invention

The present invention concerns an electron source as well as a method to operate an electron source.

2. Description of the Prior Art

An electron source and a method for manufacture thereof are known from DE 30 39 283 C2. This is an electron source provided in particular for use in scientific apparatuses.

Electron sources are also used in medical apparatuses operating with x-ray radiation, for example computed tomography apparatuses. In such electron sources, an electrically heated cathode of the electron source is operated at high voltage potential while an activation circuit (at an electrical potential that barely differs from ground in comparison to the cathode) provides variables such as the heating current provided to operate the cathode. Due to the large potential difference between the high voltage side of the electron source that includes the cathode, and the low voltage side containing the activation circuit, appropriate measures must be taken for electrical isolation. Beyond the mechanical cost associated therewith, signals being transferred between the two sides are subject to a non-negligible adulteration due to the voltage difference that must be overcome.

SUMMARY OF THE INVENTION

An object of the present invention is to provide an electron source that has improved control capability compared to conventional electron sources of the type described above.

This object is achieved according to the invention by an electron source that has an electron emitter with an electron emission cathode, a high voltage unit provided for power supply of the electron emission cathode, and a low voltage unit provided to control the high voltage unit, wherein an electrically isolated (in particular optical) data transmission path is fashioned between the high voltage unit and the low voltage unit.

The electrically isolated data transmission route enables an (advantageously bidirectional) data transfer between the low voltage and high voltage sides of the electron source that is free of interfering electrical influences. The electron source thus can be operated with a single transformer coupling the high voltage side with the low voltage side, while the variables (in particular the heating current) required to control the electron emission cathode are transmitted via the non-electrical path. The transfer of measurement values that pertain to the electron emission cathode from the high voltage side to the low voltage side of the electron source on the non-electrical path can also be achieved in a corresponding manner. The electron source is designed overall to be compact and weight-saving as well as economically manufacturable due to saving on inductive couplers.

In a preferred embodiment, the electron emitter has a control electrode in addition to the electron emission cathode. The control electrode can be fashioned as a screen. The value of the control voltage used to activate the control electrode or a parameter from which this value can be determined can be transferred with high precision via the electrically isolated data transmission path.

According to preferred development, a signal processing unit that is fashioned to process both signals transferred from the low voltage unit signals transferred from the exemplary embodiment (possibly also the control electrode) pertaining to measurement values is integrated into the high voltage unit. Beyond the detection of the electrical resistance of the electron emission cathode, such measurement values permit conclusions as to their wear and/or temperature. It is likewise possible to process results acquired in a different manner and/or pertaining to other components, in particular from temperature measurements conducted on the high voltage side of the electron source.

Independent of the applied measurement principle, the temperature of the electron emission cathode can be used as a control variable for operation of the electron emitter. A limitation of the temperature of the electron emission cathode is likewise possible in a simple and permissible manner, which in particular benefits its lifespan. In general, determinations as to the degree of wear of the electron emission cathode can be automatically made from the measured properties of the electron emission cathode using the signal processing unit forming a part of the electron source.

The signal processing unit connected in terms of data with the non-electrical data transmission path is advantageously also provided to determine the actual emission flow near the electron emission cathode. The measurement process is in practice not influenced by capacitances in conductors. A relatively precise (in comparison to the prior art) tube current regulation is achieved, even in the activation of the high voltage, as is a measurement of the after-emission during the deactivation.

The screen voltage present at the electron emitter can be detected and regulated precisely in terms of data, using measurement devices located in the high voltage part of the electron source. The same applies for the measurement of the screen current. Operation of the electron source with exactly reproducible set parameters is therefore facilitated. The measurement of the screen current moreover allows a quantitative evaluation of the quality of the vacuum which exists in the cathode unit. Even before the application of the high voltage, the temperature required at the electron emission cathode for the desired emission current can be regulated with the heating current as a control variable.

In an embodiment, only one unipolar high voltage line is provided for the voltage supply of the electron emitter. Neither heating power nor control voltage need to be directed via this high voltage line. Parasitic elements inevitably occurring otherwise in a multipolar high voltage line (such as capacitance per unit length and resistance per unit length) which would have a negative influence on the cited variables (heating power, control voltage) therefore do not apply. The unipolar high voltage line advantageously has resistance damping. This can be realized in the form of a separate electrical resistor or as a resistance line. Due to the compact design of the electron source, the resistance damping can be arranged in proximity to the at least one electron emission cathode as well as possibly a cathode unit comprising a number of control electrodes, such that particularly advantageous properties are achieved with regard to electromagnetic compatibility (EMV) as well as self-preservation upon the occurrence of arcing in the vacuum.

An advantage of the invention is a very fast, highly precise, bidirectional signal transmission is enabled, that is usable for activation, measurement, monitoring, regulation and evaluation purposes, by the provision of a non-electrical (in particular optical) path for data transmission between the low voltage side and the high voltage side of an electron source.

BRIEF DESCRIPTION OF THE DRAWING

The single FIGURE is a simplified circuit diagram of an exemplary embodiment of an electron source in accordance with the invention.

DESCRIPTION OF THE PREFERRED EMBODIMENTS

An electron source 1 suitable for a medical x-ray-emitting apparatus (not shown in further detail) comprises a high voltage unit 2, a low voltage unit 3 as well as an inductive coupler 4 as a connection element between the high voltage unit 2 and the low voltage unit 3. The high voltage unit 2 as well as the entire inductive coupler 4 (namely a transformer) are located in an x-ray radiator housing 5. The boundary of the high voltage region is indicated by a dashed line. This is an enclosed region, and it should be noted that additional components (not shown) may be located in the high voltage region within the x-ray radiator housing 5.

In region of the x-ray radiator housing 5 to the right in the FIGURE, a cathode unit 6, which is indicated by a dash-dot frame in the schematic representation, is located entirely within the high voltage region. In the shown exemplary embodiment, the cathode unit 6 has two electron emitters 7, 8, that respectively have an electron emission cathode 9, 10 as well as a control electrode 11, 12. The power supply of the electron emission cathodes 9, 10 ensues via the high voltage unit (labeled as a whole with the reference character 2) formed by intermediate circuits 13, 14. The design of this high voltage unit is discussed in further detail in the following.

At the low voltage side, the low voltage unit (labeled with the reference character 3) provided to control the high voltage unit 2 has a signal transformer 15 connected to the inductive coupler 4 as well as a coupling element 16 suitable for non-electrical (namely optical) data transmission. This optical coupling element 16 interacts via an optical signal line 17 together with a second coupling element 18 arranged in the high voltage unit 2 so that an electrically isolated, bidirectionally usable data transmission path is formed.

The coupling element 18 arranged on the high voltage side of the electron source 1 is connected in terms of data with a signal processing unit 19 which is likewise arranged in the high voltage unit 2. The signal processing unit 19 acts together with signal transformers 20 which are connected via rectifier circuits 21 to the high voltage side of the transformer 4.

Variables that pertain to the heating current of the electron emission cathodes 9, 10 and/or the control voltage of the control electrodes 11, 12 can be conducted from the low voltage unit 3 via the data transmission path 16, 17, 18 to the signal processing unit 19, which conducts corresponding electrical signals to the signal transformer 20. As shown in the FIGURE, each of the signal transformers 20 is provided to control an electron emission cathode 9, 10 or a control electrode 11, 12 by means of conductors 22, 23.

The signal processing unit 19 operated at a high voltage potential of typically a few kV is fashioned not only to transfer the variables (such as control voltages and heating currents) required to activate the electron emitters 7, 8 to the cathode unit 6, but also to enable the acquisition and processing of measurement values pertaining to the electron emitters 7, 8. This allows the actual emission current of each electron emitter 7, 8 to be precisely determined, as well as the voltage drop via the emitter resistance within the high voltage unit 2, and the corresponding data are transferred via the signal processing unit 19 and the data transfer path 16, 17, 18 to the low voltage side. The emitter resistance of each electron emitter 7, 8 can be calculated exactly in this manner. The precision of the determination of the emitter resistance is achieved primarily because no precision loss between the high voltage side and the low voltage side of the electron source 1 occurs due to the optical data transmission. The acquired measurement values are advantageously used in a control circuit that enables a stable, reproducible operation of the electron source 1.

A unipolar high voltage line 24 has a damping resistor 25 in proximity to the entrance into the x-ray radiator housing 5, and is provided for high voltage supply of the electron emitter 7, 8. Instead of the intermediate circuit of a damping resistor, the formation of the entire high voltage line 24 as a resistance line is also possible. In both cases, since separate lines 22, 23 are provided for control voltages and heating currents, a possible capacitance per unit length or resistance per unit length (as it would be documented given a multipolar high voltage line) has no disadvantageous influence on the cited variables (i.e. control voltage and heating current) which, independent of the high voltage line 24, are transformed in the high voltage unit 2 based on data transferred by means of the optical signal line 17.

Although modifications and changes may be suggested by those skilled in the art, it is the intention of the inventors to embody within the patent warranted hereon all changes and modifications as reasonably and properly come within the scope of his contribution to the art.

We claim as our invention:

1. An electron source comprising:

an electron emitter comprising an electron emission cathode;

a high voltage unit connected to the electron emission cathode that supplies power thereto, said high voltage unit comprising a processor therein configured to obtain at least one measurement value pertaining to operation of said election emitter;

a low voltage unit configured to control operation of the high voltage unit; and an electrically isolated data transmission path between the high voltage unit and the low voltage unit, said low voltage unit supplying data comprising said control instructions to the high voltage unit via the electrically isolated data transmission path; and said processor in said high voltage unit being configured to receive said control instructions and to adjust said control instructions dependent on said at least one measurement value to produce a processor output, and to supply said processor output to said electron emitter to control said operation of said electron emitter.

2. An electron source as claimed in claim 1 wherein said data transmission path is an optical data transmission path.

3. An electron source as claimed in claim 1 wherein said data transmission path is a bi-directional data transmission path.

4. An electron source as claimed in claim 1 wherein said electron emitter has a control electrode operated by said processor output signal.

5. An electron source as claimed in claim 4 wherein said control electrode is a screen electrode.

6. An electron source as claimed in claim 1 comprising a unipolar high voltage line connecting said high voltage unit to said electron emitter for supplying power to said electron emitter.

7. An electron source as claimed in claim 6 wherein said high voltage line comprises resistance damping.

8. A method for operating an electron source, comprising the steps of:

supplying an electron emitter with voltage from a high voltage unit to cause an electron emission cathode of said electron emitter to emit electrons;

controlling operation of said high voltage unit with a low voltage unit according to control signals;

supplying data representing said control signals from said low voltage unit to said high voltage unit via a non-electrical path between the high voltage unit and the low voltage unit;

with a processor in said high voltage unit, obtaining at least one measurement value pertaining to operation of said electron emitter; and in said processor, adjusting said control signals dependent on said at least one measurement value to produce a processor output, and supplying said processor output to said electron emitter to control said operation of said electron emitter.

9. A method as claimed in claim 8 comprising measuring a current flowing through the electron emission cathode, and generating a measurement value corresponding to said current and supplying said measurement value from said high voltage unit to said low voltage unit non-electrically.

10. A method as claimed in claim 8 comprising measuring a resistance of said electron emission cathode and generating resistance data corresponding thereto, and supplying said resistance data from said high voltage unit to said low voltage unit non-electrically.

11. A method as claimed in claim 8 comprising measuring a temperature of the electron emission cathode and using the measured temperature in said low voltage unit to generate a control signal for operating said electron emitter.

12. A method as claimed in claim 8 comprising transferring data via said non-electrical path from said low voltage unit to said high voltage unit that relate to a control electrode that interacts with said electron emission cathode.

13. An electron source as claimed in claim 1 wherein said processor is configured to obtain, as said at least one measurement value pertaining to operation of said electron emitter, a measurement of a temperature of said electron emission cathode.

* * * * *